US008461703B1

(12) United States Patent
Dunn et al.

(10) Patent No.: US 8,461,703 B1
(45) Date of Patent: Jun. 11, 2013

(54) INTEGRATED EXTERNAL COMBUSTION RADIAL PISTON ENGINE-GENERATOR

(75) Inventors: Paul M. Dunn, West Kingston, RI (US); Christopher J. Egan, South Kingstown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 307 days.

(21) Appl. No.: 13/092,297

(22) Filed: Apr. 22, 2011

(51) Int. Cl.
*F02P 1/00* (2006.01)

(52) U.S. Cl.
USPC ..... 290/1 A; 123/43 R; 123/3

(58) Field of Classification Search
USPC ..... 290/1 A; 123/3
See application file for complete search history.

(56) References Cited

U.S. PATENT DOCUMENTS 4,960,082 A * 10/1990 Sullivan et al. ..... 123/43 A
6,230,670 B1 * 5/2001 Russell ..... 123/44 B
7,474,020 B2 * 1/2009 Pal ..... 310/17
7,984,702 B2 * 7/2011 Russell ..... 123/162
8,004,133 B2 * 8/2011 Wilson, II ..... 310/83
8,113,165 B2 * 2/2012 Russell ..... 123/149 A
8,151,759 B2 * 4/2012 Wright ..... 123/233
8,334,604 B1 * 12/2012 Dunn et al. ..... 290/1 A
2010/0139600 A1 * 6/2010 Russell ..... 123/149 A
2012/0073296 A1 * 3/2012 Courson ..... 60/670

* cited by examiner

*Primary Examiner* — Joseph Waks
(74) *Attorney, Agent, or Firm* — James M. Kasischke; Michael P. Stanley; Jean-Paul A. Nasser

(57) ABSTRACT

A engine-generator is provided which has a rotary engine formed with an engine housing having an output surface portion and an output shaft on a central axis extending externally of the engine housing. A generator has a stator secured to the output end of the shaft and has a surface in a confronting relation with the engine housing. Permanent magnets and windings are secured to the respective surface portion of the engine housing and stator at a radial distance from the axis. Each magnet and winding has a corresponding pole face lying in a corresponding one of a pair of first planes orthogonal to the central axis. The magnets and windings are rotatable with respect to each other and periodically align in a confronting relationship to define an air-gap between the parallel planes. The windings produce electrical output in response to rotation of the magnets relative to each other.

13 Claims, 1 Drawing Sheet

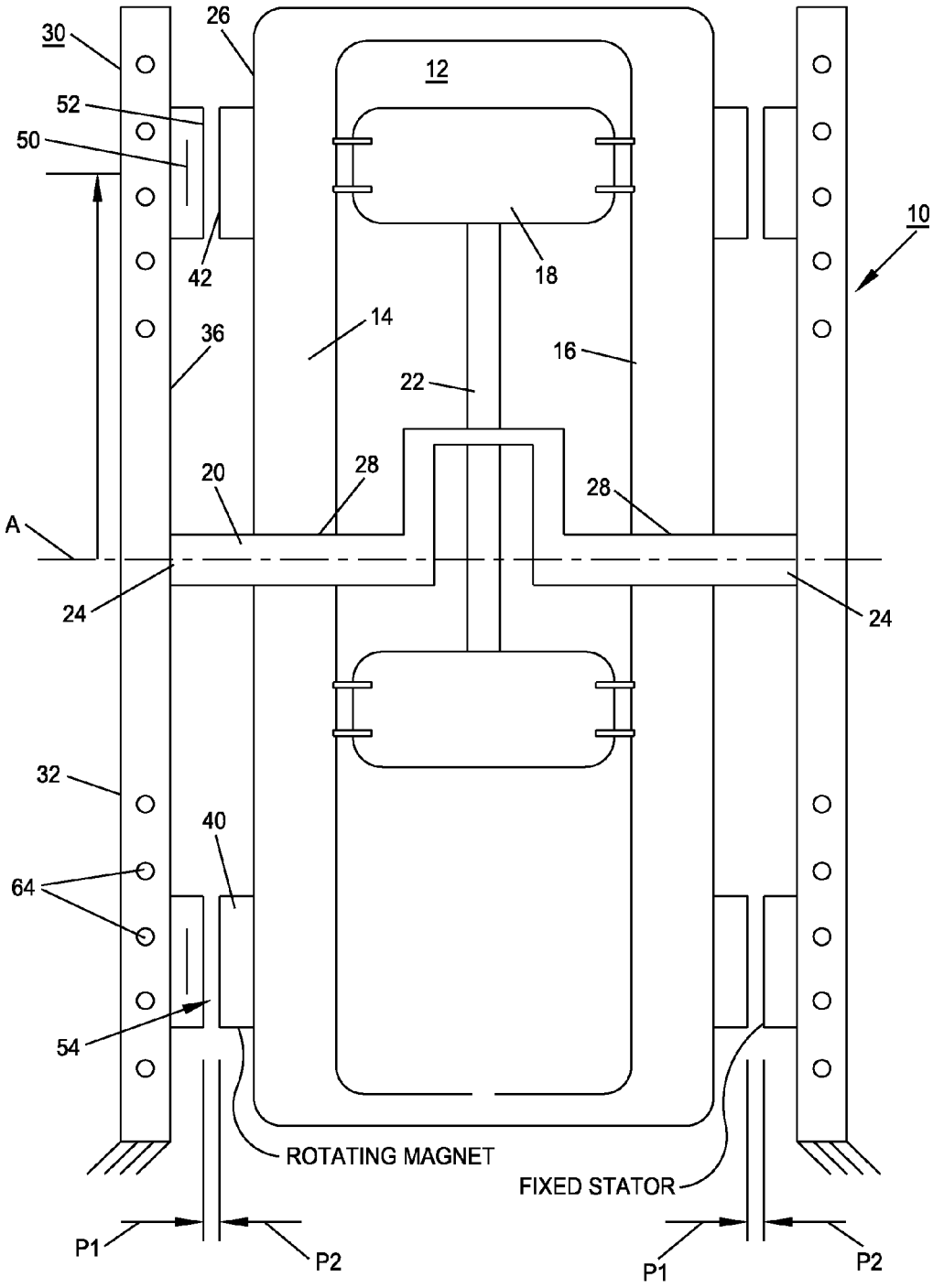
30
26
12
52
50
10
42
18
14
36
16
22
20
28
28
A
24
24
32
40
64
54
ROTATING MAGNET
FIXED STATOR
P1
P2
P1
P2

INTEGRATED EXTERNAL COMBUSTION RADIAL PISTON ENGINE-GENERATOR

STATEMENT OF GOVERNMENT INTEREST

The invention described herein may be manufactured and used by or for the Government of the United States of America for Governmental purposes without the payment of any royalties thereon or therefor.

CROSS REFERENCE TO OTHER PATENT APPLICATIONS

None.

BACKGROUND OF THE INVENTION (1) Field of the Invention

The present invention is directed to a compact external combustion engine-generator that is capable of increasing energy generation in unmanned submersibles or unmanned undersea vehicles.

2) Description of the Prior Art

Unmanned Undersea Vehicles (UUVs), which operate independent of air, typically use thermal engines with air-independent fuels or use electrical power with energy delivered by primary batteries, secondary batteries, fuel cells and the like. The range of these non-air breathing vehicles is limited.

The range may be significantly increased if an air-breathing engine is used to recharge the batteries. This is a method used in which a diesel engine drives a generator which charges the batteries. The method has not yet been widely implemented with UUVs, because the engine and generator occupy a large amount of space and have substantial weight; thereby; leaving little allocation for fuel storage, batteries and payload.

Accordingly, it is desirable to employ a compact air-breathing engine-generator combination for use in UUVs.

SUMMARY OF THE INVENTION

The invention is a compact engine-generator employing an integrated rotary engine and generator. In the invention, the output crankshaft and housing are mounted for rotation with respect to each other. The generator has a stator secured to an end portion of the output crankshaft. Permanent magnets are secured to the engine housing at a radial distance from the axis. Each magnet has a first pole face lying in a first plane orthogonal to the central axis.

Windings are affixed to the stator at a radial distance from the central axis. Each winding has a corresponding second pole face lying in a second plane orthogonal with the central axis and being spaced apart from and confronting the first plane. The first pole and second pole are rotatable with respect to each other for periodically aligning in a confronting relationship to define an air-gap therebetween. The windings produce an electrical output in response to rotation of the magnets relative thereto.

In an exemplary embodiment, the engine has a housing formed with external surface portions. An output crankshaft has ends extending outwardly through openings in the housing on a common central axis. A generator is secured to the ends of the crankshaft. Surface portions of the housing are disposed in a confronting relationship with corresponding surface portions of the stator.

Permanent magnets are affixed to or imbedded in the surface portions of the engine housing at a radial distance from the axis. Each magnet has a corresponding first pole face lying in a first plane orthogonal to the central axis. Windings are affixed to or imbedded in the corresponding surface portions of the stator at a radial distance from the central axis. Each winding has a corresponding second pole face lying in a second plane orthogonal with and confronting the first plane in a spaced relationship. The first pole and second pole are rotatable with respect to each other and periodically align in an confronting relationship to define an air-gap. The windings produce an electrical output in response to rotation of the magnets relative to the windings. In an exemplary embodiment, the engine is a radial piston rotary engine.

BRIEF DESCRIPTION OF THE DRAWINGS

FIG. 1 is a schematical internal view of an engine-generator using a radial piston, rotary engine.

DETAILED DESCRIPTION OF THE INVENTION

In various described embodiments, the term "rotary engine" is used. A rotary engine generally refers to an engine where the engine housing rotates and the crankshaft is stationary. One type of rotary engine (namely a radial piston rotary engine) employs reciprocating pistons having an odd number of cylinders per row in a radial configuration.

In such an arrangement, the crankshaft is held stationary and the cylinder block rotates about the crankshaft. In another type of rotary engine, namely a lobed rotor rotary engine (known as the Wankel engine) is a pistonless engine, which employs a lobed rotor which rotates relative to the engine housing. In one embodiment, the rotating engine housing is affixed with surface-mounted or imbedded permanent magnets which rotate within a fixed stator coil and forms the rotating component of the generator/alternator.

As illustrated in FIG. 1, there is shown an engine-generator 10 having a radial piston rotary engine 12. The engine-generator 10 includes an engine housing 14 formed with radial cylinders 16 and pistons 18 mounted for a rectilinear motion within a corresponding cylinder. The pistons 18 are coupled to a stationary and contiguous output crankshaft 20 having a central axis "A" via connecting rods 22. The radial piston rotary engine is known to those ordinarily skilled in the art and is not discussed in detail other than to describe the relative motion of the engine housing 14, which rotates and the crankshaft which is stationary.

The crankshaft 20, has a pair of output ends 24 secured in openings 28 of the engine housing 14. The crankshaft 20 translates the rectilinear motion of the pistons 18 to rotate the housing. The housing 14 has external outwardly-facing surface portions 26 that rotate with the housing about the crankshaft 20.

The engine-generator 10 has a generator 30, including a fixed stator 32 coupled to the output ends 24 of the crankshaft 20. The stator 32 is formed with inwardly-facing external surface portions 36 in a confronting relationship with the outwardly-facing external surface portions 26 of the engine housing 14. The stator 32 is fixed to the output ends 24 of the crankshaft 20.

Permanent magnets 40 are affixed to or imbedded in the outwardly-facing surface portions 36 of the engine housing 14 at a selected fixed radial distance from the central axis A for rotation therewith. The magnets 40 are arranged such that each has a pole face 42 lying in a corresponding one of a pair of first planes P1 orthogonal to the central axis.

Stator windings 50 are wound onto the stator 32 adjacent to the inwardly-facing external surface portion 36 at the selected radial distance from the axis A. Each winding has a pole face 52 lying in a corresponding one of a pair of second planes P2 orthogonal with the central axis A and parallel to the first planes P1. As the housing 14 rotates, the pole faces 42 of the magnets 40 are periodically carried into a confronting relationship with the pole faces 52 of the stator windings; thereby, forming a controlled dimension air-gap 54 through with flux passes therebetween. The stator windings 50 are wound in an electrical configuration to match the number of permanent magnet pole pairs and to generate induced electrical current as the engine housing 14 rotates.

The rotating engine housing 14 is configured with gas inlet ports and exhaust valve ports (not shown) to control the sequence of working fluid flow to and from the cylinders.

A high pressure working fluid (for example: hot gas) is ported into the cylinders from a combustion chamber and inlet tube (not shown). The hot gas imparts an axial force on the pistons 18; thereby, resulting in rotary motion of the engine housing 14 with respect to the stator 32. Cooling channels 64 enable heat removal from the stator 32.

In known configurations, diesel-electric power plants are separately housed and mechanically connected by a coupling shaft. In an embodiment of the invention, the radial piston rotary engine portion and the magnet generator 30 are combined into a single integrated housed device; thereby, reducing size and weight, and enabling smaller, lighter devices for use in UUV applications.

Alternative embodiments may employ a spark ignition internal combustion engine, a compression ignition internal combustion engine or an external combustion engine. The engine may be powered by combustion of a monopropellant or bi-propellant fuel/oxidizer energy source. The engine may be configured with one or more cylinders, pistons or rotor lobes.

The various embodiments employ different engine and generator components, but are not limited to any particular type of engine-generator. Because there are many variables, assumptions and parameters involved in designing the engine-generator described herein; it is not possible to describe all the possible designs. However, it is believed that the described embodiments are sufficient to enable one of ordinary skill in the art to find a useful design for a particular application.

What is claimed is:

1. An engine-generator comprising:

a rotary engine having a housing formed with an aperture on a central axis;

an output crankshaft having an end portion extending through the aperture with said crankshaft and said housing being mounted for rotation with respect to each other;

a generator having a stator secured to said end portion of said crankshaft;

a plurality of magnets secured to said housing at a radial distance from the central axis with each magnet having a first pole face lying in a first plane orthogonal to the central axis; and a plurality of windings affixed to said stator at a radial distance from the central axis, each of said windings having a corresponding second pole face lying in a second plane orthogonal with the central axis and being spaced from and confronting the first plane with said first and second poles being rotatable with respect to each other for periodically aligning in a confronting relationship to define an air-gap therebetween said windings for producing an electrical output in response to rotation of the said magnets relative to said windings.

2. An engine-generator according to claim 1 wherein said rotary engine is a radial piston rotary engine.

3. An engine-generator according to claim 1 wherein said rotary engine comprises a lobed rotor rotary engine.

4. An engine-generator according to claim 1 wherein said magnets are disposed in recesses within said housing.

5. An engine-generator according to claim 1 wherein the windings are wound in recesses within the stator.

6. An engine-generator according to claim 1 wherein said stator is fixed and said housing is rotatable relative thereto.

7. An engine-generator according to claim 1 wherein said stator is affixed to said output shaft and said housing is rotatable relative to said output shaft and said stator.

8. An engine-generator according to claim 1 wherein said engine is an external combustion engine.

9. An engine-generator according to claim 1 wherein said engine is an internal combustion engine.

10. An engine-generator according to claim 1 wherein said engine-generator further comprises:

a plurality of pistons sleeved within cylinders formed in said housing with each of said pistons mounted for rectilinear motion therein toward and away from the central axis; and a connecting rod for connecting each of said pistons to said crankshaft for converting the rectilinear motion of said pistons to rotary motion of said shaft.

11. The engine-generator according to claim 10 wherein said stator is fixedly secured to the end of said shaft such that said housing and said magnets carried thereby rotate with respect to said windings on said stator.

12. The engine-generator according to claim 11 wherein the stator is fixed such that the engine housing rotates with respect thereto.

13. An engine-generator comprising:

a rotary engine having a housing and output shaft openings formed in opposite sides of said housing and being disposed on a central axis;

a rotor mounted for rotation with respect to said housing about the central axis;

an output shaft secured to said rotor, mounted for rotation with respect to said housing having output end portions extending through said apertures externally of said housing;

a generator having a stator fixedly secured to said end portions of said output shaft for rotation therewith said stator confronting said apertures in said housing;

a plurality of magnets secured to said housing at a first radial distance from the central axis, each having a corresponding first pole face lying in a corresponding one of a pair of a first planes orthogonal to the central axis; and a plurality of windings affixed to said stator at a second radial distance from the central axis with each of said windings having a corresponding second pole face lying in a corresponding one of a pair of second planes orthogonal with the central axis and being spaced from and confronting one each of the first planes, said first pole and said second pole pieces being rotatable with respect to each other for periodically aligning in a confronting relationship to define an air-gap therebetween said windings for producing an electrical output in response to rotation of said magnets relative to said windings.

* * * * *